US010641006B1

(12) United States Patent
Haile

(10) Patent No.: US 10,641,006 B1
(45) Date of Patent: May 5, 2020

(54) LEVERAGING TOO FOR TRAILER LATCHES

(71) Applicant: Ricky H Haile, Cantonment, FL (US)

(72) Inventor: Ricky H Haile, Cantonment, FL (US)

( * ) Notice: Subject to any disclaimer, the term of this patent is extended or adjusted under 35 U.S.C. 154(b) by 64 days.

(21) Appl. No.: 15/813,487

(22) Filed: Nov. 15, 2017

Related U.S. Application Data

(63) Continuation-in-part of application No. 14/922,478, filed on Oct. 26, 2015, now Pat. No. 9,529,263, which is a continuation-in-part of application No. 13/434,572, filed on Mar. 29, 2012, now abandoned.

(51) Int. Cl.
*E05B 1/00* (2006.01)
*E05B 83/10* (2014.01)
*B66F 15/00* (2006.01)

(52) U.S. Cl.
CPC ..... *E05B 1/0053* (2013.01); *B66F 15/00* (2013.01); *E05B 83/10* (2013.01)

(58) Field of Classification Search
USPC ..... 7/100, 166; 81/177.1, 177.2
See application file for complete search history.

(56) References Cited

U.S. PATENT DOCUMENTS 3,985,188 A * 10/1976 Steele ..... B25C 7/00 173/170
4,644,600 A * 2/1987 Fugate ..... B25B 27/02 7/166
D328,017 S * 7/1992 Boeke ..... D8/21
7,726,032 B1 * 6/2010 Hernandez ..... B26B 21/523 30/334
9,752,348 B2 * 9/2017 Leach ..... E05B 1/0053

* cited by examiner

*Primary Examiner* — Joseph J Hail
*Assistant Examiner* — Shantese L McDonald
(74) *Attorney, Agent, or Firm* — Peter Loffler

(57) ABSTRACT

A leveraging tool for helping urge open a shipping container or van trailer door latch has a shaft that has a pair of rings that receive a latch arm of the door latch and uses the lever action of the shaft to gain mechanical advantage in opening and closing the latch. The shaft is bent at either one location or optionally two locations to allow for proper clearance of a user's hands with respect to the door. The inner ring has a distal end facing outer edge that is diagonally tapered to allow the device to properly clear the latch in order to allow the rings to receive the latch.

6 Claims, 2 Drawing Sheets

LEVERAGING TOO FOR TRAILER LATCHES

This application is a Continuation-In-Part of U.S. patent application Ser. No. 14/922,278, filed on Oct. 26, 2015, which is a Continuation of U.S. patent application Ser. No. 13/434,572 filed on Mar. 29, 2012, now abandoned, each application is incorporated herein by reference in its entirety.

BACKGROUND OF THE INVENTION

1. Field of the Invention

The present invention relates to a leveraging tool that helps lift a trailer door of a shipping container combination latch arm back up into its closed and secured position.

2. Background of the Prior Art

Over the road trucking is a demanding job. Not only must the driver actually drive the truck and its cargo laden trailer, but many chores must be performed when the truck and trailer are stopped. Various maintenance checks must be routinely performed to assure safe and reliable locomotion of the truck on the road and the van trailer, shipping container and their cargo must be properly secured. These are a few of the numerous tasks that a trucker must routinely perform in order to get his or her job done quickly, safely and on time.

One aspect of trucking involves latching and unlatching the shipping container or van trailer door latch. The unlatching of the trailer door does not often present major difficulties. The latch is pushed down and the latch opens. Even if the latch is sticking somewhat due to wear, rust or misalignment, a rubber mallet or even a hammer or even the weight of the trucker is all that is needed to unlatch all but the most stubborn of latches. However, the closing of the latch can be difficult. The latch arm is pulled upwardly to allow the latch to be received within a keeper on the other door. If the shipping container or van trailer and its latch hardware are relatively new, only modest force is required to close most such latches. However, as time goes on and the latch hardware becomes worn and possibly rusty and the shipping container or van trailer doors move out of true alignment, getting the latch arm to come down can be a challenge. Often even large strong truckers must exert substantial force in order to properly close the latch. When the driver is relatively small or short, the problem is increased. When faced with a stubborn latch, truckers turn to a stick or other similar device to act as a lever to give the trucker mechanical advantage, a useful if inelegant and inefficient solution.

What is needed is a tool that assists truckers with the above mentioned tasks associated with the trucking operation. Specifically, such a tool must assist the trucker in quickly and easily placing a shipping container or van trailer door latch into the closed position even if the latch is worn or rusty and even if the trailer doors are out of alignment.

SUMMARY OF THE INVENTION

The leveraging tool for trailer latches of the present invention address the aforementioned needs in the art by providing a tool that assists truckers in opening a latch door and especially helps place a door latch into its closed position even if the latch hardware is worn or rusty and even if the shipping container or van trailer doors are not properly aligned. This tool is quite effective even if used by relatively small and relatively short users. The leveraging tool for trailer latches is of relatively simple design and construction so as to be relatively inexpensive to produce using standard manufacturing techniques so as to be readily affordable to a large segment of potential consumers for this type of product. The leveraging tool for trailer latches is quick and easy to use and is relatively compact so to take up minimal valuable real estate within a truck or trailer.

The leveraging tool for trailer latches of the present invention is comprised of a leveraging tool that is formed as a shaft member that has a first end and an opposing second end and formed as a first section located at the first end and a second section located at the second end. The first section has an upper surface and an opposing lower surface joined by a pair of side surfaces. The second section diagonally downwardly in the lower surface facing direction forming an obtuse angle between the two sections. A first ring member is attached to the upper surface of first section of the shaft member and is located proximate the first end of the shaft member. The first ring member has a first opening. A second ring member is attached to the upper surface of first section of the shaft member between the first ring member and the second end of the shaft member. The second ring member has an outer edge that faces the first ring member. The second ring member also has a second opening that is aligned with the first opening of the first ring member such that a first central longitudinal axis that passes through the first opening and the second opening is parallel with a second central longitudinal axis that passes through the first section of the shaft member. A handle encircles the shaft member proximate the second end. The second section of the shaft member may be formed as a first sub-section and a second sub-section the first sub-section joining the first section and the second sub-section and wherein the second sub-section is bent upwardly in the upper surface facing direction relative to the first sub-section. The outer edge of the second ring is diagonally tapered toward the second end in proceeding up from the upper surface.

BRIEF DESCRIPTION OF THE DRAWINGS

Similar reference numerals refer to similar parts throughout the several views of the drawings.

DESCRIPTION OF THE PREFERRED EMBODIMENT

Figures 1, 1A:
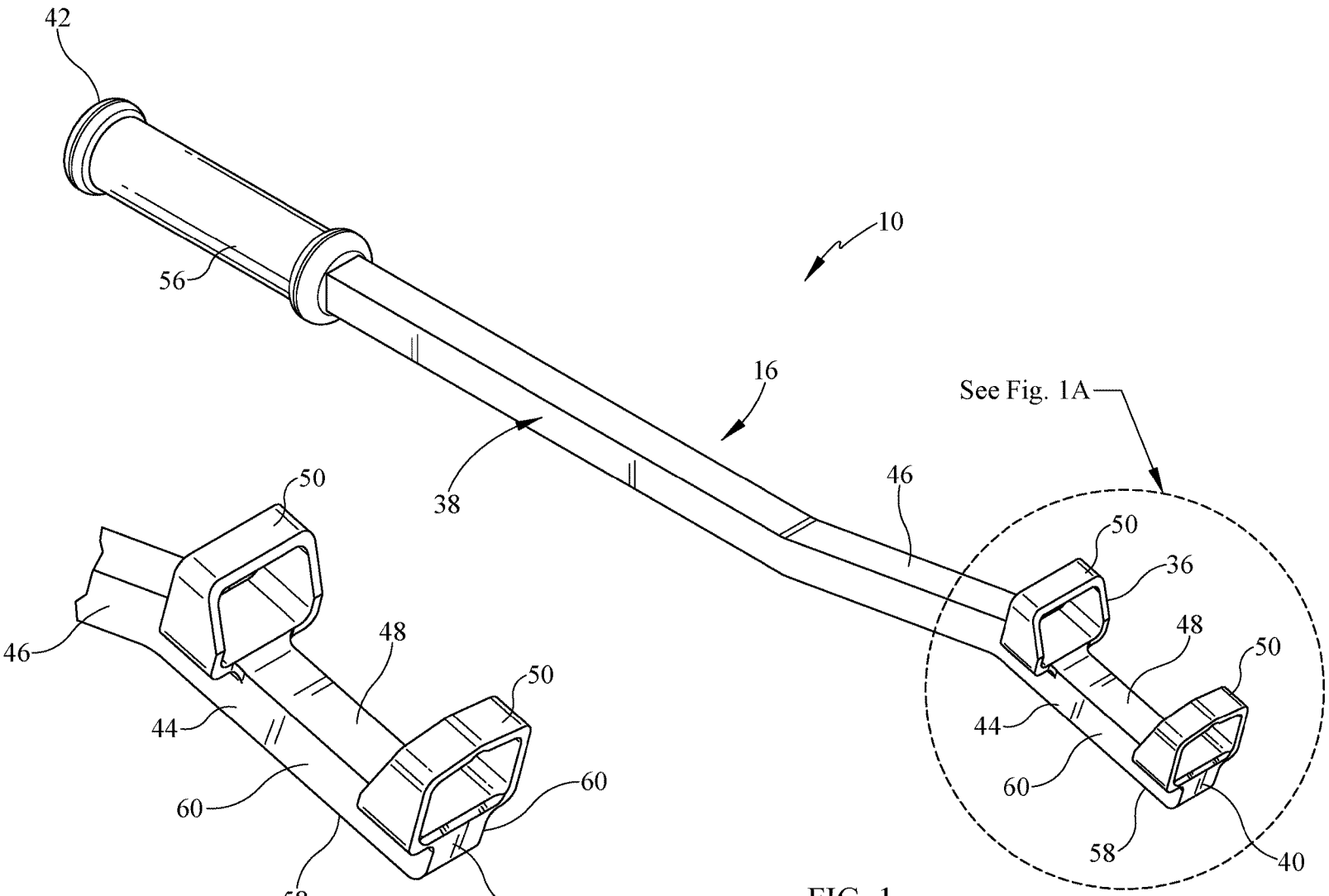
FIG. 1 is a perspective view of the leveraging tool for trailer latches of the present invention.
FIG. 1A is a close-up perspective view of the latch engaging end of the leveraging tool for trailer latches.

Referring now to the drawings, it is seen that the leveraging tool for trailer latches of the present invention, generally denoted by reference numeral 10, are comprised of a leveraging tool that has a shaft member 38 having a generally rectangular cross section and having a first end 40 and a second end 42. As seen, the shaft member 38 has a bent configuration with a relatively short first section 44 that has an upper surface 48 and an opposing lower surface 58, joined by a pair of side surfaces 60 and a relatively longer second section 46, bent downwardly in the lower surface 58 facing direction. The second section 46 may be substantially straight, or as illustrated, have a slight upward bend medially along its length. Located on the upper surface 48 of the first section 44 of the shaft member 38 is a pair of spaced apart ring members 50—the two ring members 50 are aligned which means that a central longitudinal axis that passes through their respective openings is substantially parallel with a central longitudinal axis that passes through the first section 44 of the shaft member 38. As seen, at least the first end facing outer edge 36 of the inner ring member 50 is diagonally tapered toward the second end 40 in proceeding up from the upper surface 48 of the first section 44 of the shaft member 38. The other ring member 50 may, but need not necessarily be similarly tapered for manufacturing convenience if the ring members 50 are manufactured as separate items and attached to the shaft member 38 as more fully discussed below. The shaft member 38 is made from heavy ½" solid steel and bent into its configuration with the ring members 50 attached to the shaft member 38 in appropriate fashion such as via welding or is a solid cast or forged steel member with the ring members 50 formed during forging or attached thereto in appropriate fashion in order for the shaft member 38 to withstand the forces placed on the shaft member 38. A handle 56 encircles the shaft member 38 proximate to the second end 42.

Figure 2:
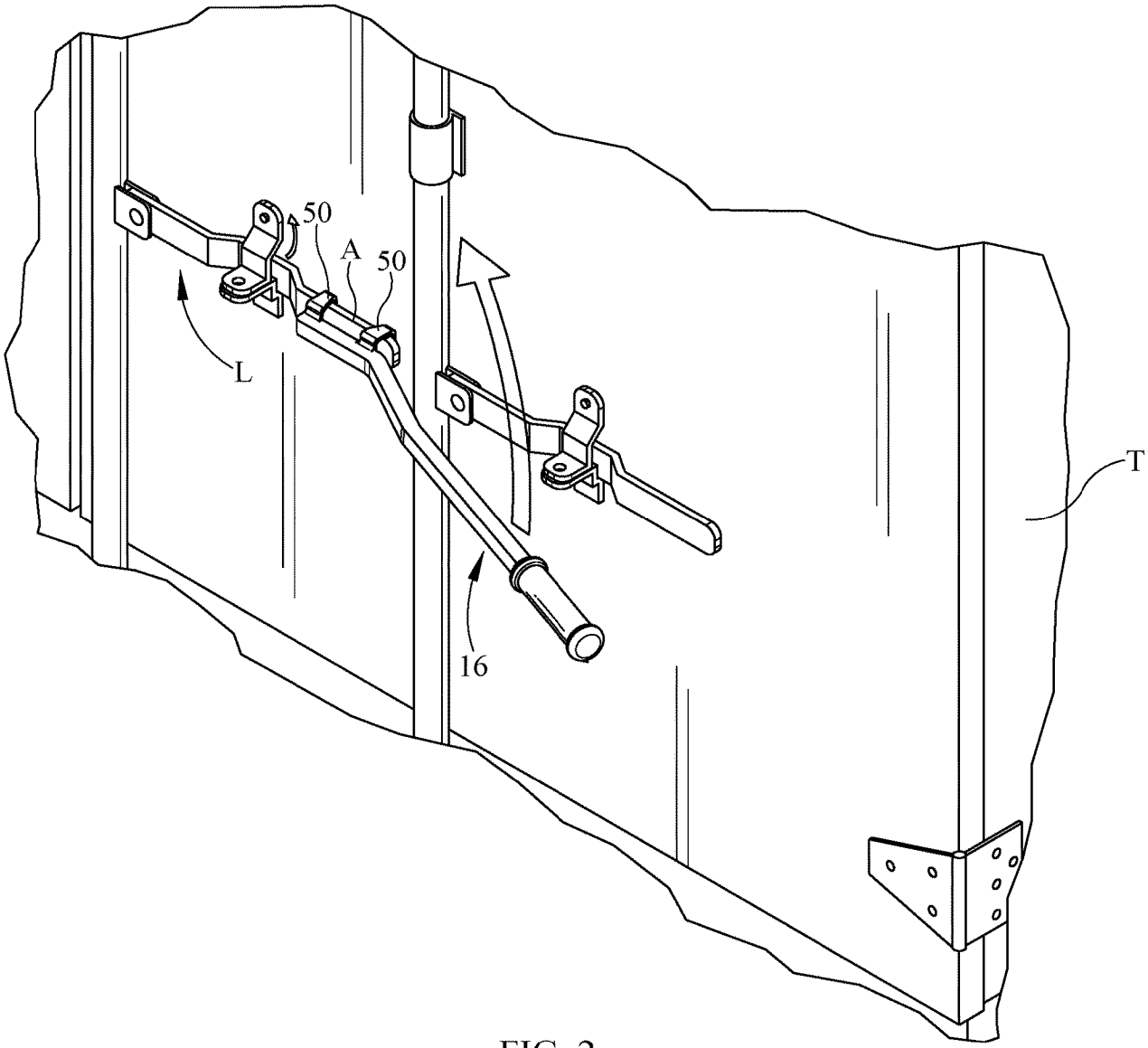
FIG. 2 is an environmental view of the leveraging tool for trailer latches of FIG. 1 being used to close a latch on a trailer.

As seen in FIG. 2, the latch arm A of a latch L of a trailer T is received within the ring members 50. The ring members 50 have a generally rectangular cross section to correspond to the cross section of the latch arm A. The tapered outer edge 36 of the inner ring member 50 helps the device clear the latch L when positioning the leveraging tool for trailer latches 10 onto the latch, so that the ring members 50 can properly receive the latch L. The user now grips the shaft member 38 via the handle 56 in order to force the arm A upwardly (or downwardly when using the tool 16 to open the latch L), the shaft member 38 acting as a lever giving the user mechanical advantage. The bent configuration of the shaft member 38 allows the second end 42 of the shaft member 38 as well as the user's hands to clear any obstructions on the rear edge of the trailer T and of the trailer door itself.

The door latch posts of each model of container or trailer T are different. The leveraging tool for trailer latches 10 is designed with specific angles to assist the user in clearing the post allowing the tool to slide onto the latch L, enabling opening or closing of the door of most models of shipping container or van trailer doors.

While the invention has been particularly shown and described with reference to an embodiment thereof, it will be appreciated by those skilled in the art that various changes in form and detail may be made without departing from the spirit and scope of the invention.

I claim:

1. A truck tool comprising:

a shaft member having a first end and a second end and having such that a first section is formed at the first end and has an upper surface and an opposing lower surface joined by a pair of side surfaces, the shaft member also having a second section formed at the second end, the second section oriented diagonally downwardly in the lower surface facing direction;

a first ring member attached to and extending upwardly from the upper surface of first section of the shaft member and located proximate the first end of the shaft member, the first ring member having a first opening; and a second ring member attached to and extending upwardly from the upper surface of first section of the shaft member between the first ring member and the second end of the shaft member, the second ring member having an outer edge that faces the first ring member, the second ring member also having a second opening, the second opening aligned with the first opening of the first ring member such that a first central longitudinal axis that passes through the first opening and the second opening is parallel with a second central longitudinal axis that passes through the first section of the shaft member and such that the first opening and the second opening are each dimensioned to receive a latch arm of a latch of a truck trailer.

2. The truck tool as in claim 1 further comprising a handle encircling the shaft member proximate the second end.

3. The truck tool as in claim 2 wherein the second section of the shaft member is formed as a first sub-section and a second sub-section the first sub-section joining the first section and the second sub-section and wherein the second sub-section is bent upwardly in the upper surface facing direction relative to the first sub-section.

4. The truck tool as in claim 3 wherein the outer edge of the second ring is diagonally tapered toward the second end in proceeding up from the upper surface.

5. The truck tool as in claim 1 wherein the second section of the shaft member is formed as a first sub-section and a second sub-section the first sub-section joining the first section and the second sub-section and wherein the second sub-section is bent upwardly in the upper surface facing direction relative to the first sub-section.

6. The truck tool as in claim 1 wherein the outer edge of the second ring is diagonally tapered toward the second end in proceeding up from the upper surface.

* * * * *